US005861820A

United States Patent [19]

Kerner et al.

[11] Patent Number: 5,861,820

[45] Date of Patent: Jan. 19, 1999

[54] METHOD FOR THE AUTOMATIC MONITORING OF TRAFFIC INCLUDING THE ANALYSIS OF BACK-UP DYNAMICS

[75] Inventors: Boris Kerner, Stuttgart; Heribert Kirschfink; Hubert Rehborn, both of Aachen, all of Germany

[73] Assignee: Daimler Benz AG, Germany

[21] Appl. No.: 970,757

[22] Filed: Nov. 14, 1997

[30] Foreign Application Priority Data

Nov. 14, 1996 [DE] Germany ..... 196 47 127.3

[51] Int. Cl.[6] ..... G08G 1/065

[52] U.S. Cl. ..... 340/934; 340/919; 340/936; 701/118; 701/119

[58] Field of Search ..... 340/907, 932, 340/933, 934, 935, 936, 919; 701/117, 118, 119, 201

[56] References Cited

U.S. PATENT DOCUMENTS

| | | | |
|---|---|---|---|
| 5,296,852 | 3/1994 | Rathi | 340/934 |
| 5,459,665 | 10/1995 | Hikita et al. | 701/118 |
| 5,530,441 | 6/1996 | Takatou et al. | 340/937 |
| 5,696,502 | 12/1997 | Busch et al. | 340/934 |

FOREIGN PATENT DOCUMENTS

| | | |
|---|---|---|
| 43 00 650 A1 | 7/1994 | Germany . |
| 44 08 547 A1 | 10/1995 | Germany . |

OTHER PUBLICATIONS

F. Busch, "Automatic Recognition of Distrubances on Expressways—A Comparison of Methods", Dissertation, Karlsruhe, 1986.

K Everts, et al., "Comments Concerning the Traffic Flow Analysis, the Detection of Disturbances and the Traffic Flow Prediction for Influencing Traffic in Outlying Areas", Forschungsgesellschaft fur Strassen–und Verkehrswesen, *FGS-V–Bericht* 358, 1992;.

J. Acha–Datsa and F.L. Hall, "Implementation of a Catastrophe Theory Model for the Incident Detection component of an Intelligent Highway System", 12th Congreso Mundial IRF, Madrid, 1993, p. 579.

G. J. Forbes, "Identifying Incident Congestion", *ITE Journal*, Jun. 1992, p. 17.

H. Zackor, et al., "Investigations Concerning the Traffic Flow with Respect to Capacity and in the Case of an Instable Flow," *Forschung Strassenbau and Strassenverkenhrstechnik*, vol. 524, 1988.

L. Kuehne, "Traffic Flow on Highways", *Phys. B1*, 47 (1991), p. 201.

*Primary Examiner*—Daniel J. Wu

*Attorney, Agent, or Firm*—Evenson, McKeown, Edwards & Lenahan P.L.L.C.

[57] ABSTRACT

In a method for automatically monitoring traffic, traffic data are recorded at several measuring points of the traffic network. The time-dependent positions of the upstream back-up flank and of the downstream back-up flank are estimated continuously according to characteristic relationships which take into account the flow and the density of the traffic in the back-up, the point in time at which the upstream back-up flank passes a respective first measuring point, the point in time at which the downstream back-up flank passes this measuring point as well as the flow and the average vehicle speed at this first as well as at a second measuring point which is situated upstream of the upstream back-up flank.

10 Claims, 3 Drawing Sheets

METHOD FOR THE AUTOMATIC MONITORING OF TRAFFIC INCLUDING THE ANALYSIS OF BACK-UP DYNAMICS

BACKGROUND AND SUMMARY OF THE INVENTION

This application claims the priority of 196 47 127.3, the disclosure of which is expressly incorporated by reference herein.

The invention relates to a method for automatically monitoring traffic, including analysis of back-up dynamics, in which traffic measuring data are recorded at several measuring points of the traffic network.

Methods of this type are customary in the field of traffic routing engineering for recognizing disturbances or back-ups. In such methods, data concerning the traffic situation (such as the traffic flow and the average vehicle speed) are recorded at measuring points, for example by means of induction loop systems and/or beacon systems, and the measured data are appropriately analyzed. In order to forecast back-up dynamics between adjacent measuring points, different traffic models were developed. Two serious difficulties occur, however, in the development and use of such traffic models. On the one hand, the determination of the model parameters frequently depends on outside influences, such as the momentary environmental and weather conditions. Thus, a parametric pattern of one model which was validated once may suddenly change profoundly for the same road section of the traffic network; for example, because the road is becoming increasingly wet. On the other hand, it is difficult to develop a model which is valid for the whole possible vehicle density range and for different traffic situations.

Conventional methods of this type are disclosed in the following publications: F. Busch, "Automatic Recognition of Disturbances on Expressways—A Comparison of Methods", Dissertation, Karlsruhe, 1986; K. Everts, et al., "Comments Concerning the Traffic Flow Analysis, the Detection of Disturbances and the Traffic Flow Prediction for Influencing Traffic in Outlying Areas", Forschungsgesellschaft fur Straβenund Verkehrswesen, *FGSV-Bericht* 358, 1992; J. Acha-Datsa and F. L. Hall, "Implementation of a Catastrophe Theory Model for the Incident Detection Component of an Intelligent Highway System", 12th Congreso Mundial IRF, Madrid, 1993, Page 579; G. J. Forbes, "Identifying Incident Congestion", *ITE Journal,* June 1992, Page 17; H. Zackor, et al., "Investigations Concerning the Traffic Flow with Respect to Capacity and in the Case of an Instable Flow," *Forschung Straβenbau und Straβenverkehrstechnik,* Volume 524, 1988; and L. K ühne, "Traffic Flow on Highways", *Phys. B*1., 47 (1991), Page 201.

German patent document DE-0S 44 08 547 A1 discloses a method for detecting traffic and recognizing traffic situations in which traffic data, such as vehicle speeds, traffic volume and traffic density, are determined at several measuring points. From the traffic data of two neighboring measuring points which form a measuring section of a certain route length, traffic parameters are formed. Specifically a speed density difference is determined according to a predetermined relationship, a trend factor is formed from the relationship of the traffic volumes at the two measuring points, and a traffic volume trend of each measuring point is derived from the rise of the tangent of the time-dependent traffic volume course. These three traffic parameters are processed using fuzzy logic to recognize critical traffic situations in the measuring section in question. The result is utilized to generate corresponding control signals for alternating traffic lights.

German patent document DE-OS 43 00 650 A1 discloses a method for determining vehicle-type-related traffic flow data on roads. The number of passing vehicles and their lengths are detected in successive measuring intervals at different observation points, taking into account the driving direction, and the data thus obtained are analyzed to determine a density condition variable. The value of the density condition variable is compared with a limit value and the amount and the direction of the deviation from the limit value are used to draw conclusions regarding the start of a back-up, the existence of a back-up, or a clearing-out of the back-up.

An object of the present invention is to provide a method of the type mentioned above which, with a given measuring point distribution over the traffic network, can determine reliably the time-related and space-related change of traffic congestion, at relatively low expenditures.

Another object of the invention is to provide such a method which is suitable for predicting travel time and for automatically controlling traffic influencing systems.

These and other objects and advantages are achieved by the present invention, which uses plausible assumptions to continuously estimate the time-dependent positions of the upstream and downstream flanks of a traffic back-up, based on characteristic relationships which utilize the recorded traffic measuring data in a manner which is easy to analyze. In this case, the word "downstream" applies to the driving direction in a particular considered lane; that is, in the case of a back-up, the back-up direction pointing to the start of the back-up. The word "upstream" on the other hand, applies to the opposite direction; that is, in the case of a back-up in the considered lane, the back-up direction pointing to the end of the back-up.

An important advantage of this method is the fact that it operates reliably without any additional validation of the parameters, theoretically for unlimited distances between measuring points, in different traffic situation scenarios, such as different road conditions, in the form of wetness, snow, etc. In contrast, models which try to reconstruct the traffic flow by solving differential equation systems require a large number of validating parameters.

In one embodiment of the invention the selection of the two measuring points whose measured traffic data are entered into the analysis of the back-up dynamics appropriately follows the location change of a back-up. Thus, the traffic measuring data which are situated as close as possible to the back-up flanks are always used. This has an advantageous effect on the precision of the analysis of the back-up dynamics.

In another embodiment of the invention, the process is used for predicting the travel time for drives on back-up stressed traffic network sections.

Still another embodiment of the invention permits an adequate consideration of entry roads and exit roads which are situated between two measuring points of a road section and which, in turn, are provided with corresponding measuring points for traffic entering and exiting there.

Yet another embodiment takes into account a change in the number of lanes of a back-up stressed road section between the corresponding measuring points.

Other objects, advantages and novel features of the present invention will become apparent from the following detailed description of the invention when considered in conjunction with the accompanying drawings.

DETAILED DESCRIPTION OF THE DRAWINGS

Figure 1:
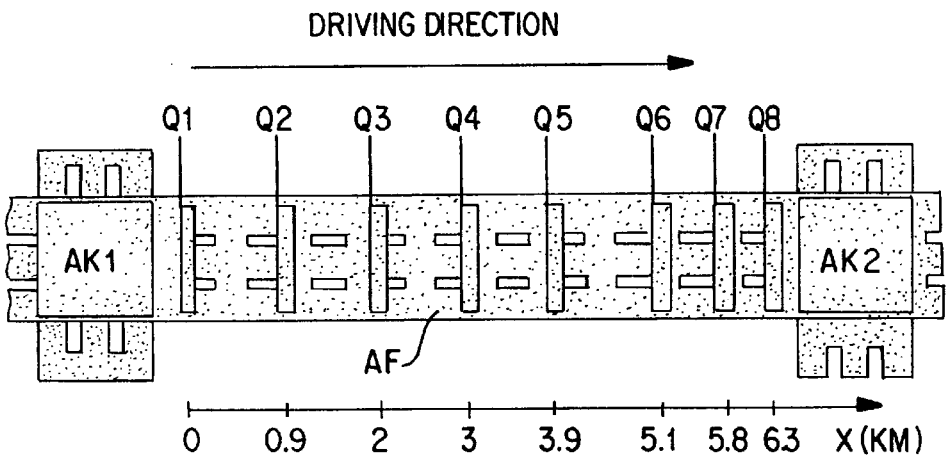
FIG. 1 is a block diagram of a three-lane limited access highway section with several mutually spaced measuring points.

FIG. 1 illustrates a three-lane highway section AF between an upstream highway intersection AK1 and a downstream highway intersection AK2. Eight measuring points Q1 to Q8 are provided in the form of respective induction loop detectors with distances between measuring points of between 500 m and 1,200 m. Every minute, the measuring points Q1 to Q8 supply traffic measurement data to a conventional traffic routing center (not shown), which is equipped with a suitable mainframe computer for monitoring and routing traffic. Such traffic measuring data include the average vehicle speed and the traffic flow, separately according to the vehicle types (passenger car and truck) and individually for each of the three lanes. As required, each lane can be analyzed individually, or average values are used for all lanes.

Figure 2:
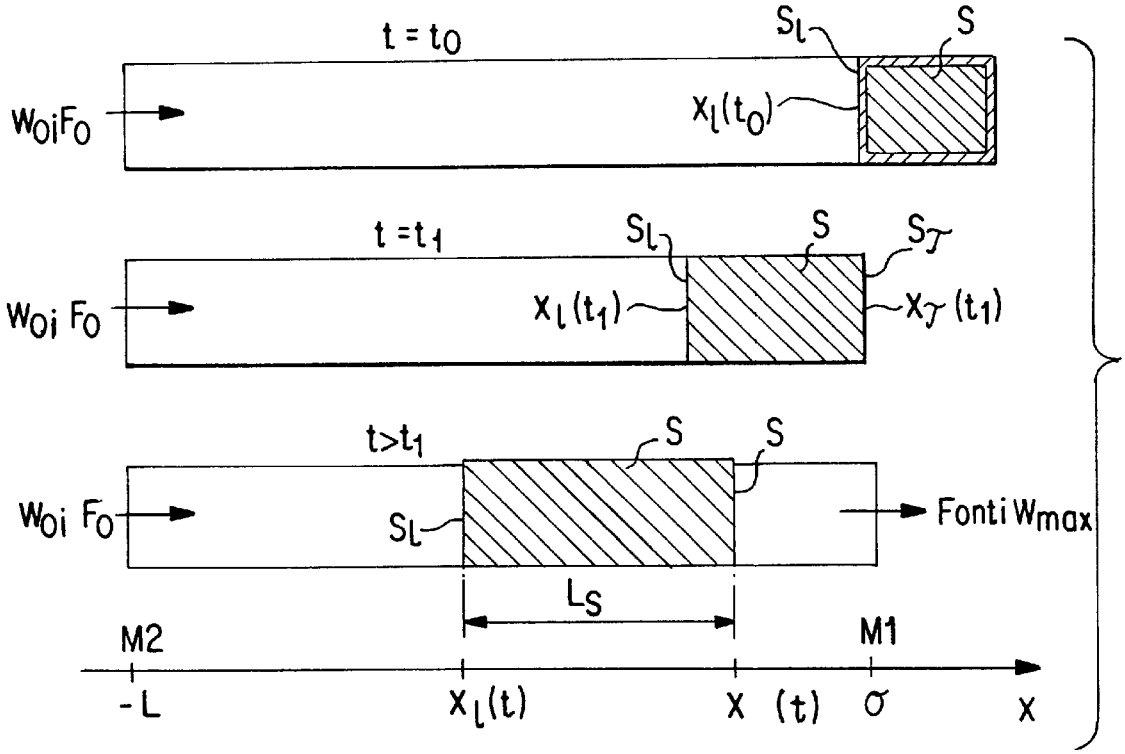
FIG. 2 is a schematic diagram for illustrating a back-up propagating between two measuring points.

FIG. 2 illustrates as an example a back-up propagating into the area between two measuring points M1, M2, together with the quantities or variables relevant for the method according to the invention. The driving direction on the lane or lanes considered here extends in the illustrated positive x-direction. The x-coordinate of a first downstream measuring point M1 is set to the 0 value so that the x-coordinate of the second measuring point M2 spaced by a distance L upstream away from the first measuring point M1 has the value −L. The flow and the average speed, as measured continuously at the first measuring point M1, have the symbols $q_{out}$ and $w_{max}$. Analogously, the vehicle flow and the average vehicle speed, as measured at the second measuring point M2, have the symbols $q_0$ and $w_0$.

As a result of the vehicles approaching the back-up, the upstream flank $S_1$ of a developing back-up S propagates upstream. Analogously, the downstream back-up flank $S_r$, with a starting clearing-out of the back-up, also propagates upstream in that the vehicles at the forward front of the back-up will then again have a clear run. The upper partial illustration in FIG. 2 shows the situation at a point in time $t=t_0$ at which the measured average vehicle speed massively collapses at the downstream first measuring point M1 (that is, it falls abruptly within a short time). From this event it is concluded that a back-up S has formed which has reached the first measuring point M1 with its upstream flank $S_1$. Therefore, the location coordinate $x_1$ of the upstream back-up flank $S_1$ has the value 0, that is $x_1(t_0)=0$ at this point in time. If it is later determined at time $t=t_1$ that the average vehicle speed rises again considerably at the first measuring point M1, this indicates that the traffic is again flowing freely; that is, that the downstream back-up flank $S_r$ is just passing the first measuring point M1. This means that at this point in time $t_1$, the location coordinate $x_r$ of the downstream back-up flank $S_r$ has the value 0; that is $x_r(t_1)=0$. This is illustrated in the partial center picture of FIG. 2 which also shows that the upstream back-up flank $S_1$ has in the meantime advanced by the route section $x_1(t_1)$ upstream.

Thereafter, the back-up S propagates from the first measuring point M1 upstream in the direction of the second measuring point M2, as illustrated in the lower partial picture of FIG. 2. By the method according to the invention, the location $x_1(t)$ of the upstream back-up flank $S_1$ as well as that $x_1(t)$ of the downstream back-up flank $S_r$ between the two neighboring measuring points M1 and M2 can now be continuously estimated in a relatively precise manner. As a result, a continuous, precise estimated value is also available for the back-up length $L_s$. The result of this automatic traffic monitoring with respect to back-ups can then be used in the traffic routing center not only for providing back-up reports and back-up warnings but also for more extensive, traffic guidance measures, such as for establishing travel time predictions, for controlling traffic influencing systems and/or for making detour recommendations.

In the method according to the invention the positions $x_1$ and $X_r$ of the upstream back-up flank $S_1$ and the downstream backup flank $S_r$ for the selection of coordinates according to FIG. 2 are estimated based on the following relationship:

$$x_l(t) = -\int_{t_0}^{t} \frac{q_0(t) - q_{min}}{\rho_{max} - q_0(t)/w_0(t)}\, dt,\ t \geqq t_0$$

$$x_r(t) = -\int_{t_1}^{t} \frac{q_{out}(t) - q_{min}}{\rho_{max} - q_{out}(t)/w_{max}(t)}\, dt,\ t \geqq t_1$$

In addition to the above-mentioned measurable variables $q_0$, $w_0$, $q_{out}$, $w_{max}$, the measured flow $q_{min}$ in the back-up and the traffic density $p_{max}$ are also entered into these equations, which traffic density $p_{max}$ is determined by way of the relationship:

$$\rho_{max} = \frac{1000}{L_{PKW} \cdot (1 - A_{LKW}) + L_{LKW} \cdot A_{LKW}} \left[ \frac{Fzg.}{km} \right]$$

The present example is based on two different vehicle types, specifically passenger cars and trucks. It is known that suitable sensors can distinguish between passenger cars and trucks, as discussed in the initially mentioned literature. $A_{LKW}$, in this case, indicates the proportion of trucks in the traffic flow, while the remainder consists of passenger cars $A_{PKW}$; that is $A_{PKW}=1-A_{LKW}$. The average vehicle length including the vehicle spacing in the back-up is in each case appropriately indicated by $L_{PKW}$ and $L_{LKW}$ for the passenger cars and the trucks; for example, $L_{PKW}=7$ m and $L_{LKW}=17$ m. From the estimated location coordinate values $x_r$ and $x_1$ for the downstream and upstream backup flanks $S_R$, $S_1$, the estimated value $L_s$ for the back-up length as a function of the time will then be $$L_S(f)=x_r(f)-x_l(f),\ t \geqq f_i$$

This method of automatically monitoring traffic with an analysis of back-up dynamics can thus be carried out with the three parameters $q_{min}$, $L_{PKW}$ and $L_{LKW}$ to be validated. The parameter $q_{min}$ can be detected by measurement in the time period $t_0<t<t_1$ at the first measuring point M1; for the time period $t>t_1$ which follows, an approximate traffic density which was obtained by averaging the previous traffic density values might be used. In the most frequently occurring case of a high traffic volume, however, $q_{min}$ is very small in comparison to $q_0$ as well as in comparison to $q_{out}$, so that $q_{min}$ can then be neglected in the above equations in a good approximation. In this case, only the parameters $L_{PKW}$ and $L_{LKW}$ need be validated, neither of which is seriously dependent on local situation changes on the monitored road section, for example, on weather conditions. These different characteristic lengths of the different vehicle types may therefore be firmly predetermined in the model so that the method will then no longer have any parameters to be validated.

If the upstream back-up flank $S_1$ reaches the upstream measuring point M2 in FIG. 2 before the back-up S has cleared up, the measuring data $q_0$, $w_0$ of this measuring point M2 can no longer be used to estimate the back-up flank positions $x_1$ and $x_r$ according to the above equations. To measure the variables $q_0$ and $w_0$, a change is made from this previously second measuring point M2 to the measuring point which is next in the upstream S direction. A position error between the estimated and actual positions of the upstream back-up flank $S_1$ caused by this change of measuring points can be compensated by the addition of an additional transition term dx, (which, for example, is typically between 200 m and 300 m). Alternatively, it can be avoided if the point in time at which the upstream back flank $S_1$ reaches the corresponding measuring point M2 is determined by measuring, as explained above concerning the first measuring point M1 at the point in time $t_0$. An analogous transition from a previous first measuring point M1 to the measuring point which is next in the upward direction is made as soon as the measuring data of the latter are suitable for obtaining variables $g_{out}$ and $w_{max}$; that is, as soon as the downstream back-up flank $S_r$ has passed this measuring point which is next in the upstream direction. A transition error can again be avoided this time by subtracting a corresponding compensation term dx or by the direct determination of the point in time at which the downstream backup flank $S_r$ reaches the concerned measuring point, as explained in FIG. 2 with respect to the point in time $t_1$.

The method can also take into account entry roads and exit roads as well as changes in the number of lanes between neighboring measuring points. The different possibilities are illustrated schematically in FIGS. 3 to 8 for two successive measuring points $M_i$, $M_{i+1}$, in which a driving direction is assumed to extend from the left to the right, and a back-up is indicated by hatching.

Figure 3:
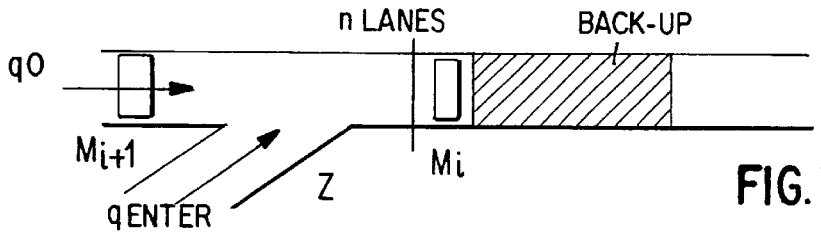
FIG. 3 is a schematic block diagram of a road section with an entry road in front of a back-up.

FIG. 3 shows the case of an entry road Z between the two measuring points $M_i$ and $M_{i+1}$, which is situated in front of the back-up. The entry road Z is also equipped with a measuring point (not shown) for recording traffic. By means of this measuring point the traffic flow $q_{ein}$ is detected which additionally enters by way of the entry road Z into the monitored N-lane road section. To take into account this additional flow $q_{ein}$ in the above equations, for estimating the position $x_1$ of the upstream back-up flank $S_1$, the variable $q_0$ is replaced by $q_0+q_{ein}/n$; that is the flow $q_{ein}$ of the entry road Z supplies the additive additional term $q_{ein}/n$. This additional term is eliminated as soon as the upstream back-up flank has reached the next measuring point $M_{i+1}$ upstream of the entry road Z.

Figure 4:
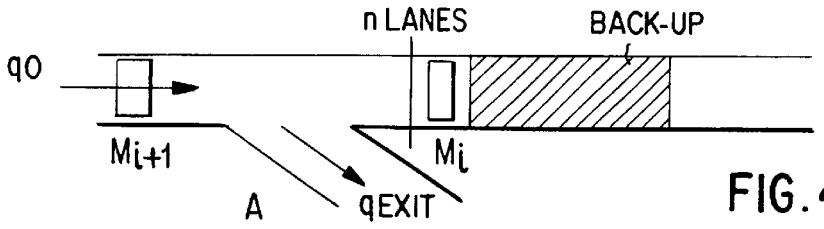
FIG. 4 is a schematic block diagram of a road section with an exit road in front of a back-up.

Analogously, FIG. 4 shows the case of an exit road A between two neighboring measuring points $M_i$, $M_{i+1}$ upstream of the back-up, the traffic flow $q_{aus}$ exiting by way of the exiting road A being detected by means of a measuring point situated there. This derived traffic flow $q_{aus}$ is taken into account in the above estimated-value equation for the location coordinate $x_1$ of the upstream back-up flank $S_1$ by the additional term $q_{aus}$, which is subtracted from $q_0$; that is $q_0$ is replaced by $q_0-q_{aus}/n$.

Figure 5:
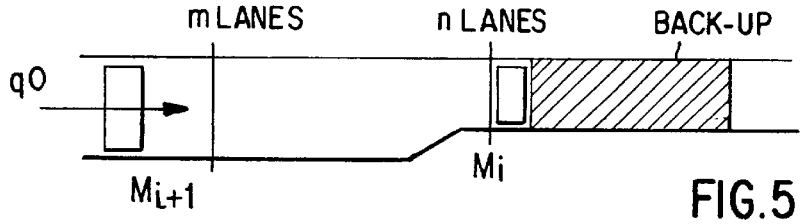
FIG. 5 is a schematic block diagram of a road section with narrowing of a lane in front of a back-up.

FIG. 5 shows the case of a narrowing of lanes from an m number of lanes at an upstream measuring point $M_{i\times1}$ to an n number of lanes at a downstream measuring point $M_i$ upstream of the back-up. In this case, the variable $q_0$ in the above estimated-value equation for $x_1$ is multiplied by the factor m/n; that is, $q_0$ is replaced by $q_0m/n$. When there is a combined presence of entry roads, exit roads and/or narrowing of lanes according to FIGS. 3 to 5, the variable $q_0$ must be correspondingly provided with the additive, subtractive and multiplicative additional terms. The multiplicative modification of the variable $q_0$ indicated for the case of the narrowing of lanes of FIG. 5 is also correct if there is a widening of lanes.

Figure 6:
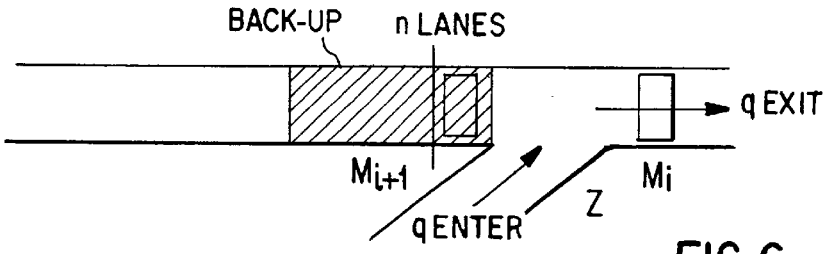
FIG. 6 is a view corresponding to FIG. 3, but with an entry road situated behind the back-up.
Figure 7:
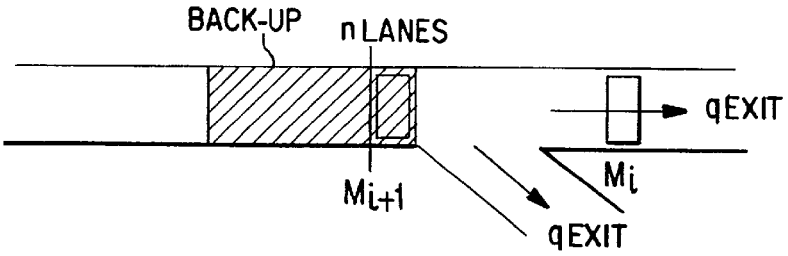
FIG. 7 is a view corresponding to FIG. 4, but with an exit road situated behind the back-up.
Figure 8:
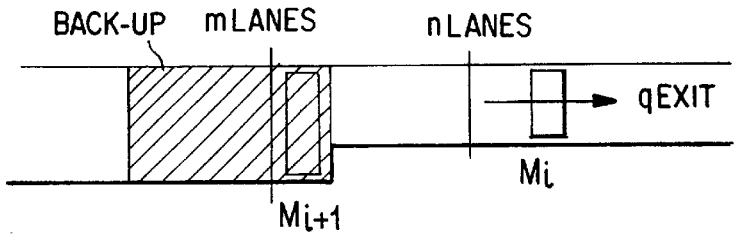
FIG. 8 is a view corresponding to FIG. 5, but with a narrowing of a lane situated behind the back-up.

FIGS. 6 to 8 show examples which are analogous to FIGS. 3 to 5, but the back-up situated in front of the corresponding entry road Z, exit road A or narrowing of lanes. In this case, instead of the variable $q_0$, the variable $q_{out}$ must be correspondingly modified. In particular, in the case of an entry road Z downstream of the back-up, as illustrated in FIG. 6, $q_{out}$ in the estimated-value equation for the position $x_r$ of the downstream back-up flank $S_r$ must be replaced by $q_{out}-q_{min}/n$. In the same manner, $q_{out}$ in this in each case is estimated-value equation in the case of the exit road A illustrated in FIG. 7 downstream of the back-up must be replaced by $q_{out}+q_{aus}/n$. If the number of lanes behind the back-up illustrated in FIG. 8 changes from m lanes to n lanes, $q_{out}$ is modified to $q_{out}.n/m$. Thus, in all cases entry roads, exit roads and changes in the number of lanes can be easily taken into account in the analysis of back-up dynamics according to the invention.

Furthermore, the method according to the invention permits a prediction concerning the point in time at which a formed back-up will have cleared up again. Such a back-up clearing prediction can be used to determine the point in time when traffic influencing measures taken by the suitable controlling of existing traffic influencing systems which counteract the back-up (such as remote-controllable speed limit signs and/or detour signs) can be eliminated. Such a back-up clearing prediction is illustrated diagrammatically in FIG. 9.

Figure 9:
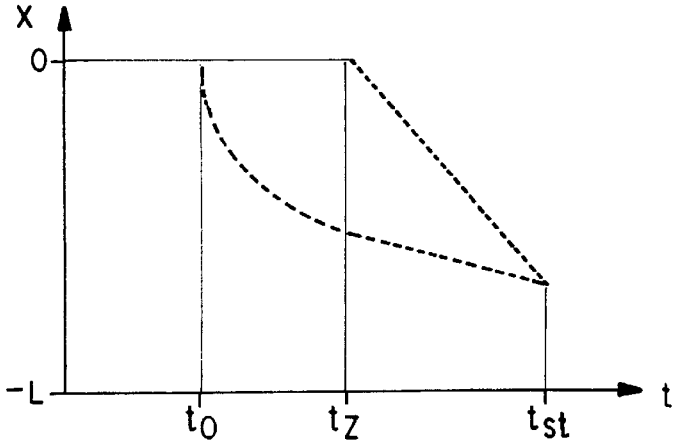
FIG. 9 is a diagram for illustrating a back-up clearing prediction.

Under plausible assumptions, the diagram of FIG. 9 can be used to estimate the clearing time $t_{st}$ of a back-up whose upstream flank according to FIG. 2 at the point in time $t_0$ has passed the first measuring point M1 situated there at x=0, based on the equation:

$$t_{st} = t_z - \frac{\int_{t_0}^{t} v_{gl}(t)dt}{v_{gl}(t_z) - v_{gr}(t_z)},$$

wherein $v_{g1}$ and $v_{gr}$ are the speeds of the upstream back-up flank $S_1$ or the downstream back-up flank $S_r$, and $t_z$ is the point in time at which the speed $v_{g1}$ of the upstream back-up flank $s_1$ has reached its smallest value. In this case, it is plausibly assumed that the speeds $v_{g1}$ and $v_{gr}$ of the upstream $S_1$ and of the downstream back-up flanks $S_1$ and $S_r$ remain constant after time $t_z$, until the point in time $t_{st}$ when the back-up clears. The above equation for determining the point in time $t_{st}$ when back-up clearing is completed results from the condition of a disappearing back-up length; that is $L_s(t_{st})=0$.

Figure 10:
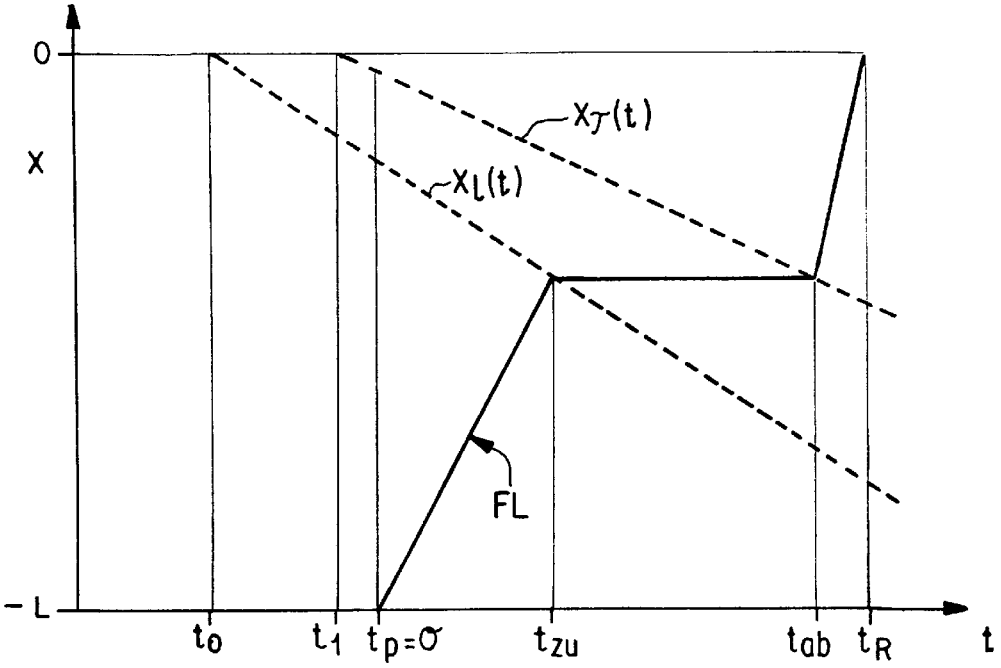
FIG. 10 is a diagram for illustrating a travel time prediction.

FIG. 10 illustrates the establishment of a short-time travel-time prediction for a drive on a monitored route section, particularly for the drive duration between two measuring points with an intermediate back-up, as generally illustrated in FIG. 2. By using the situation of FIG. 2, the travel time estimate can be determined for a travel starting time $t_p$ after the time $t_1$ when the downstream back-up flank $S_r$ has reached the downstream measuring point M1. FIG. 10 represents the travel duration estimate by means of a corresponding driving line diagram. First, the position $x_1$ of the upstream back-up flank $S_1$ at the time $t_0$ at x=0 (that is, at the first measuring point M1), and the position $x_r$ of the downstream back-up flank $S_r$ passing through the same point x=0 at a later point in time $t_1$ are shown in FIG. 10 by a broken line. Then the drive line FL is entered in the diagram, representing a drive in the direction of the downstream measuring point M1, starting at time $t_p$, at the upstream measuring point M2.

During a first drive section until the upstream back-up flank $S_1$ is reached at a point in time $t_{zu}$, this drive line FL is based on the average driving speed $w_0$ of the upstream measuring point M2. For the subsequent drive section in the back-up (that is, until the downstream back-up flank $S_r$ is reached at time tab, the average vehicle speed $W_{st}$ in the back-up is used to generate the corresponding drive line section. Since this speed $w_{st}$ is typically much lower than the average driving speed outside the back-up, the corresponding drive line section extends approximately horizontally. A last drive section of the downstream back-up flank $S_r$ to the destination location (that is, the downstream measuring point M1) is correspondingly based on the average driving speed $w_{max}$ measured at this measuring point M1. From the intersection of the drive line FL with the horizontal line at x=0, while the time zero point is set at the point in time of the start of the drive, that is, $t_F=0$, the travel time $t_R$ is then obtained at $$t_r = \frac{L + w_n t_{ab} - w_0 t_{zu} - w_{st}(t_{ab} - t_{zu})}{w_n}$$

In this case, the speed $w_{st}$ can usually be neglected so that, for the estimated travel time duration $t_R$ from the upstream measuring point M2 to the downstream measuring point M1, including the travelling through the back-up situated in this area, the approximation formula $$t_r = \frac{L + w_n t_{ab} - w_0 t_{zu}}{w_n}$$

is obtained. It is understood that, in the case of travel time predictions for driving routes which extend along several such drive sections between two measuring points, the driving times for the drive between neighboring measuring points are determined individually in the described manner, taking into account any traffic backups, and are then added up to the total estimated travel duration.

The method according to the invention can also be used when several back-ups occur between two measuring points. In this case, assuming that no entry or exit roads exist in the monitored area between the respective measuring points, the plausible assumption is used that the flow and the average speed of the vehicles in front of the upstream flank of the downstream back-up correspond to the flow and the average vehicle speed which existed downstream of the upstream back-up at the time when its downstream back-up flank has passed the downstream measuring point.

It is understood that the method according to the invention can be used not only, as described, for automatically monitoring road traffic networks, but also (in the same manner) for monitoring rail traffic networks.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Method for automatically monitoring traffic comprising:

recording traffic measurement data at several measuring points of a traffic network; and a continuously estimating time-dependent positions $x_1$ and $x_r$ of an upstream back-up flank and a downstream back-up flank, respectively, based on the relationships $$x_l(t) = -\int_{t_0}^{t} \frac{q_0(t) - q_{min}}{\rho_{max} - q_0(t)/w_0(t)}\, dt,\ t \geqq t_0$$

$$x_r(t) = -\int_{t_1}^{t} \frac{q_{out}(t) - q_{min}}{\rho_{max} - q_{out}(t)/w_{max}(t)}\, dt,\ t \geqq t_1$$

wherein (i) $q_{min}$ is traffic flow in the back-up and $p_{max}$ is traffic density in the back-up determined according to the equation $$\rho_{max} = \frac{1000}{\sum_{Fz} L_{Fz} \cdot A_{Fz}} \left[ \frac{Fzg}{\text{km}} \right]$$

with an Fz number of different vehicle types of a different average length $L_{Fz}$ participating with the respective proportions $A_{Fz}$;

(ii) $t_0$ is a time at which traffic measuring data recorded at a first measuring point with a location coordinate x=0 indicate that the upstream back-up flank has reached this measuring point;

(iii) $t_1$ is the point in time at which the traffic measuring data recorded at the first measuring point indicate that the downstream back-up flank has reached this measuring point;

(iv) $q_{out}$ and $w_{max}$ are flow and average vehicle speed of the traffic at the respective first measuring point; and (v) $g_0$ and $w_0$ are flow and average vehicle speed of the traffic at a respective second measuring point situated upstream of the upstream back-up flank.

2. Method according to claim 1, wherein at least one of the following changes is made:

a change is made from a previous measuring point to a measuring point which is next upstream as the respective second measuring point as soon as the upstream back-up flank has passed this previous measuring point; and a change is made from a previous measuring point to the measuring point next to it upstream as the respective first measuring point, as soon as the upstream back-up flank has passed this measuring point which is next upstream.

3. Method according to claim 1 wherein a driving time for a drive on a back-up stressed section from the second to the first measuring point is estimated as the sum of a time duration until the estimated upstream back-up flank is reached, an average driving speed being used as the basis which is measured at the second measuring point, plus the time duration until the estimated downstream back-up flank is reached, an average driving speed in the back-up being used as the basis, plus the time duration until the first measuring point is reached, the average driving speed measured at the first measuring point being used as the basis.

4. Method according to claim 2 wherein a driving time for a drive on a back-up stressed section from the second to the first measuring point is estimated as the sum of a time duration until the estimated upstream back-up flank is reached, an average driving speed being used as the basis which is measured at the second measuring point, plus the time duration until the estimated downstream back-up flank is reached, an average driving speed in the back-up being used as the basis, plus the time duration until the first measuring point is reached, the average driving speed measured at the first measuring point being used as the basis.

5. Method according to claim 1 wherein an entry road or an exit road between the first and second measuring points is taken into account by an additional term $q_{ein}/n$ or $q_{aus}/n$ with n as the number of lanes, which, when the entry road is situated upstream of the back-up, is added to $q_0$, and when the entry road is situated downstream of the back-up, is subtracted from $q_{out}$ or, when an exit road is situated upstream of the back-up, is subtracted from to $q_0$, and when the exit road is situated downstream of the back-up, is added to $q_{out}$.

6. Process according to claim 1 wherein a change in the number of lanes between the first and second measuring points from m lanes to n lanes is taken into account by a multiplicative factor which, when the change of the number of lanes is situated in front of the back-up, has the value m/n and is multiplied by $q_0$, and, when the change of the number of lanes is situated behind the back-up has the value n/m and is multiplied by $q_{out}$.

7. Process according to claim 2 wherein a change in the number of lanes between the first and second measuring points from m lanes to n lanes is taken into account by a multiplicative factor which, when the change of the number of lanes is situated in front of the back-up, has the value m/n and is multiplied by $q_0$, and, when the change of the number of lanes is situated behind the back-up has the value n/m and is multiplied by $q_{out}$.

8. Process according to claim 3 wherein a change in the number of lanes between the first and second measuring points from m lanes to n lanes is taken into account by a multiplicative factor which, when the change of the number of lanes is situated in front of the back-up, has the value m/n and is multiplied by $q_0$, and, when the change of the number of lanes is situated behind the back-up has the value n/m and is multiplied by $q_{out}$.

9. Process according to claim 4 wherein a change in the number of lanes between the first and second measuring points from m lanes to n lanes is taken into account by a multiplicative factor which, when the change of the number of lanes is situated in front of the back-up, has the value m/n and is multiplied by $q_0$, and, when the change of the number of lanes is situated behind the back-up has the value n/m and is multiplied by $q_{out}$.

10. Process according to claim 5 wherein a change in the number of lanes between the first and second measuring points from m lanes to n lanes is taken into account by a multiplicative factor which, when the change of the number of lanes is situated in front of the back-up, has the value m/n and is multiplied by $q_0$, and, when the change of the number of lanes is situated behind the back-up has the value n/m and is multiplied by $q_{out}$.

* * * * *